United States Patent [19]

Greene

[11] 3,966,360

[45] June 29, 1976

[54] CONTINUOUS-FLOW FLUID PUMP

[76] Inventor: James L. Greene, P.O. Box 171, Columbia, Ky. 42728

[22] Filed: Jan. 27, 1975

[21] Appl. No.: 544,512

[52] U.S. Cl. ..... 417/53; 92/82; 417/554; 417/435

[51] Int. Cl.[2] ..... F04B 39/02; F04B 21/04; F15B 21/04

[58] Field of Search ..... 417/503, 552, 430, 432, 417/250, 251, 260, 53; 92/142

[56] References Cited

UNITED STATES PATENTS

| | | | |
|---|---|---|---|
| 905,046 | 11/1908 | Baines | 417/526 |
| 1,128,089 | 2/1915 | Astrom | 92/142 |
| 1,284,642 | 11/1918 | Francis | 417/503 |
| 1,621,046 | 3/1927 | Winsor | 417/448 |
| 1,801,304 | 4/1931 | Carson | 92/86.5 |
| 1,809,814 | 6/1931 | Schutt | 417/557 |
| 2,146,328 | 2/1939 | Collins | 417/503 |
| 2,193,020 | 3/1940 | Collins | 417/495 |
| 2,413,044 | 12/1946 | Grise | 417/260 |
| 3,592,567 | 7/1971 | Tolbert | 417/432 |

*Primary Examiner*—William L. Freeh
*Attorney, Agent, or Firm*—Schuyler, Birch, Swindler, McKie & Beckett

[57] ABSTRACT

A method and apparatus are disclosed for preventing burnout of a fluid pump. The pump includes a pump casing having a pumping member disposed for movement therein. An outer casing is disposed about the pump casing so as to form a reservoir therebetween. Additionally, the pump casing is provided with a plurality of openings in order that pumped fluid may be recirculated between the interior of the pump casing and the reservoir. The openings are so constructed and arranged as to directly lubricate the pumping member as well as to insure continuous recirculation of the pumped fluid in the event the supply of fluid to be pumped should decrease.

6 Claims, 5 Drawing Figures

CONTINUOUS-FLOW FLUID PUMP

BACKGROUND OF THE INVENTION

1. Field of the Invention

The invention relates to fluid pumps and, more particularly, to a method and apparatus for preventing burnout of a pumping member by the continuous recirculation of pumped fluid.

2. Description of the Prior Art

In the fluid pumping art, a conventional pump comprises a pump casing within which a pumping member is disposed for movement. Under normal operating conditions, when there is present an adequate supply of fluid to be pumped, the pumping member is lubricated adequately by the pumped fluid. However, if the supply of fluid available to be pumped should decrease below a particular level, continued movement of the pumping member may fatally disable the pumping member due to lack of lubrication. This problem is particularly acute in certain types of oil wells, known as stripper wells, which periodically provide a low oil output and are often periodically and temporarily pumped dry. Also, in such wells, the fluid being pumped often contains abrasive material such as sand or grit, which quickly scores the surfaces of the pump elements. When such a well presents an inadequate supply of fluid to the pump, the pump will quickly be damaged.

The prior art has long recognized the above-mentioned problems, and many attempts have been made to solve them. For example, it is known to provide a timer for the pumping member, so that the pumping menber will be timed to operate only during certain periods. In this system, through trial and error, the length of a safe operating period is determined, beyond which the fluid level in the well will probably decrease to the point where the pumping member will not be adequately lubricated by the pumped fluid. This system is inefficient and often times unpredictable and inaccurate. It cannot even be established without damage to a number of pumps used in trying to determine the timing of the cycle. While it may solve the problem of burnout of the pumping member, it does not obviate the problem of scoring of the pump components, because any entrained abrasive material still will settle toward the bottom of the well and, upon startup of the pumping member after replenishment of fluid in the well, will be immediately moved through the pump in a rather large quantity, having great potential to immediately damage the pump.

Other prior art approaches have included providing sand traps for the collection of entrained abrasive material. Most commonly, an outer casing is provided, which outer casing surrounds the pump casing so as to form an annular space, or reservoir, therebetween. A plurality of openings are provided in the pump casing near the upper portion thereof to permit abrasive material to enter the reservoir and settle to the bottom thereof. Such an arrangement partially eliminates scoring of the pump casing, but it does nothing to solve the problem of burnout of the pumping member due to lack of proper lubrication. Furthermore, sooner or later the reservoir will be full of abrasive material, and the pump must then be raised to the surface to empty the reservoir.

It also has been known to provide a quantity of heavy lubricant, or grease, in such a reservoir prior to lowering of the pump into the well. In this arrangement, a second group of openings are provided in the pump casing near the lower portion thereof; additionally, a packing means is disposed within the reservoir on the upper surface of the lubricant. When the pump is operated, pumped fluid is directed into the upper portion of the reservoir, thus acting on the packing means to force the lubricant from the lower portion of the reservoir into the interior of the pump casing, via the lower group of openings. Such an arrangement tends to prevent the pump casing from being scored because the lubricant at least partially excludes abrasive material from the space between the pumping member and the pump casing. However, if the supply of fluid available to be pumped should decrease, the lubricant no longer would be forced from the reservoir into the pump casing, and the pumping member still would burnout. Additionally, once the supply of lubricant has been exhausted, no more protection against scoring of the pump casing by abrasive material is available.

Accordingly, it is an object of the invention to provide a new and improved fluid pump wherein burnout of a pumping member is prevented in the event the supply of fluid available to be pumped should decrease beneath acceptable limits.

It is another object of the invention to provide a new and improved fluid pump wherein scoring of the pump casing by abrasive material is minimized.

It is a still further object of the invention to provide a new and improved fluid pump wherein the pump casing is lubricated continuously and wherein scoring of the pump casing is prevented, without employing timed intervals of operation or lubricants other than pumped fluid.

SUMMARY OF THE INVENTION

In carrying out the invention, in one form thereof, a fluid pump includes a pump casing having a pumping member disposed for movement therein. The pump casing additionally is provided with a plurality of openings appropriately sized and spaced. An outer casing is disposed about the pump casing in order to form a reservoir therebetween. Upon movement of the pumping member, pumped fluid not only is pumped out of the well, but a portion of the pumped fluid is recirculated continuously between the interior of the pump casing and the reservoir. In the event the supply of fluid available to be pumped should decrease, a continuous, recirculating flow of pumped fluid is available to lubricate the pumping member in order to prevent burnout thereof and to prevent abrasive material from scoring the pump casing.

DESCRIPTION OF THE PREFERRED EMBODIMENT

Figure 1:
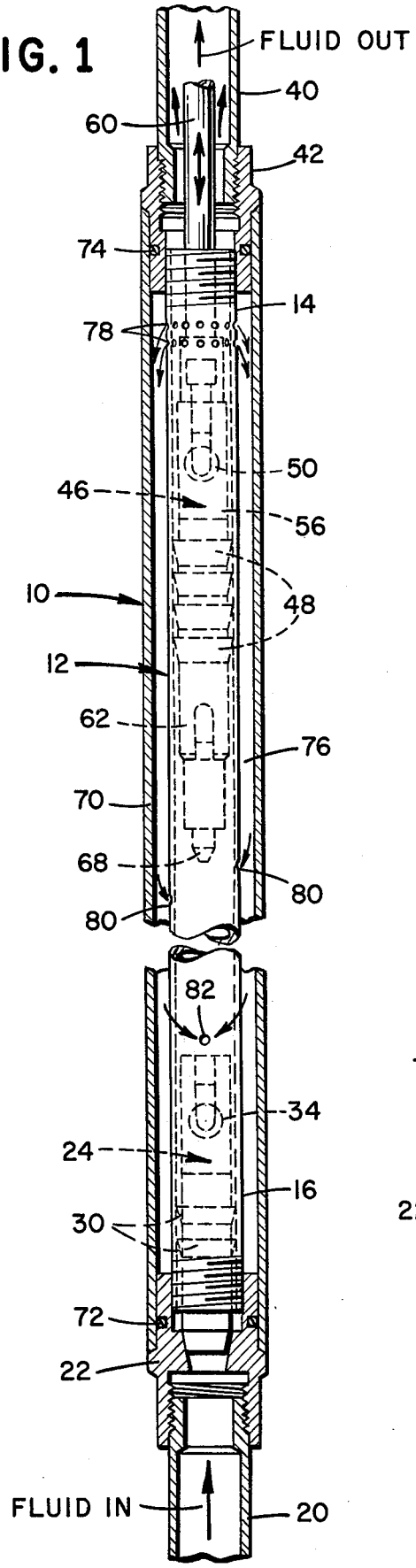
FIG. 1 is a side elevational view, partly in section, of one form of a pump according to the invention.
Figure 2:
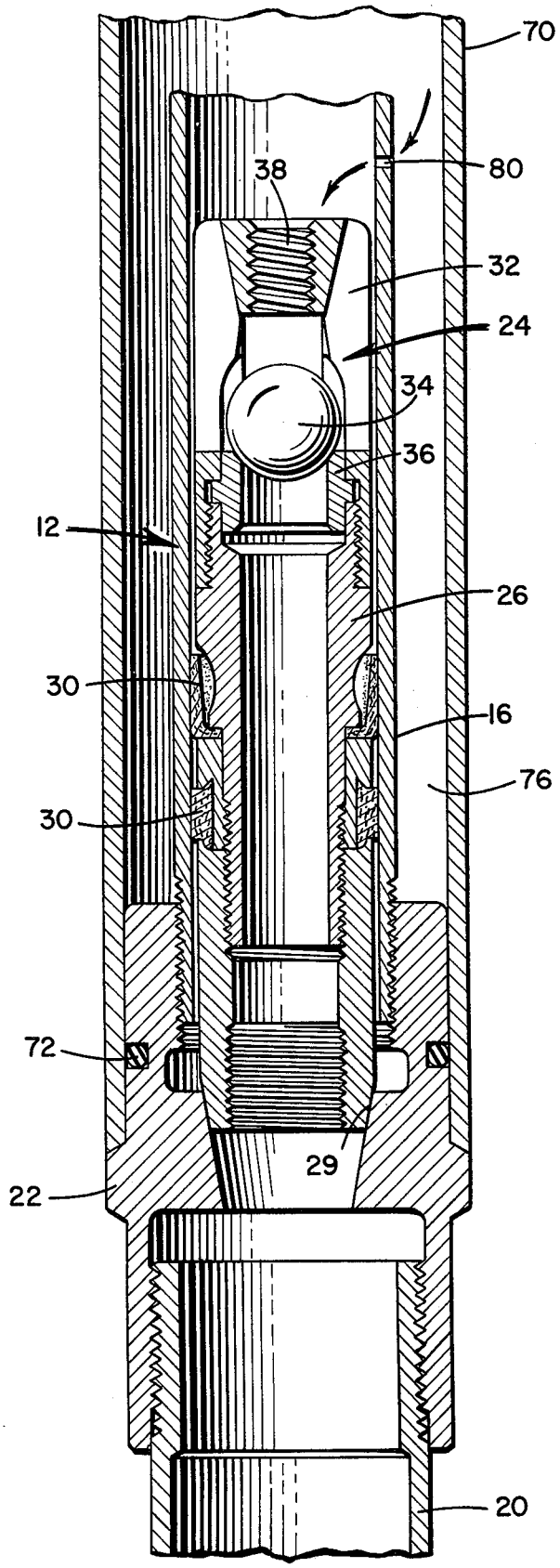
FIG. 2 is a view similar to FIG. 1 depicting the lower portion of the pump of FIG. 1.

FIGS. 1–4 show a pump 10, such as that which commonly is employed in the oil well art, although the pump may be used to pump other fluids, if desired. The structure and advantages of the invention are particularly well-suited for use in pumps in oil wells, and thus it will be described in such an environment. Pump 10 is a down-hole pump, remaining permanently at the bottom of the oil well, except for certain removable portions, which will be discussed subsequently.

Pump 10 comprises an inner, or pump casing 12. Pump casing 12 is cylindrical and has a first end portion 14 and a second end portion 16.

Pump casing 12 is permanently affixed in the well by a so-called mud anchor 20, which mud anchor is connected to end portion 16 by a threaded fitting 22. Mud anchor 20 not only serves to stabilize pump casing 12 within the well but also serves to direct oil upwardly into pump casing 12.

A stationary ball check valve or standing valve 24 is disposed within pump casing 12 proximate end portion 16. Standing valve 24 comprises a tubing 26 having an end portion 28 threadedly connected thereto. Tubing 26 tightly engages fitting 22 at 29 to prevent displacement of standing valve 24. A plurality of sealing members 30 are disposed concentrically about standing valve 24 in order to provide a fluid-tight seal between pump casing 12 and standing valve 24. Disposed near the upper portion of tubing 26 and threadedly connected thereto is a hollow, threaded portion 32. Included with portion 32 is a ball 34 having a mating piece 36. Portion 32 also includes a threaded internal portion 38 in order to remove standing valve 24 from pump casing 12 when desired. The removal of standing valve 24 will be described hereinafter. It will be noted that sealing members 30, ball 34, mating portion 36, and portion 32 combine to permit a one-way flow of oil through standing valve 24. That is, oil can flow upwardly into pump casing 12 through mud anchor 20 and standing valve 24, but cannot flow backwardly.

In order to convey oil to the surface, a well tubing 40 is provided. Tubing 40 is connected to first end portion 14 of pump casing 12 by a threaded fitting 42.

A travel valve 46 is disposed within pump casing 12 for reciprocating movement therein. Like standing valve 24, travel valve 46 is hollow and includes a plurality of sealing means, or sealing cups 48 disposed for frictional engagement with pump casing 12 so as to provide a fluid-tight seal therebetween. Travel valve 46 includes a ball check valve comprising a ball 50 which engages mating portion 52. As with standing valve 24, ball 50 is disposed within a hollow, threaded portion 54, which portion is connected threadedly to a tubing 56. The other end of portion 54 is connected threadedly at 58 to a sucker rod rod 60. Sucker rod 60 is connected at the surface end to a power source (not shown), which power source causes sucker rod 60 to reciprocate; in turn, travel valve 46 is caused to reciprocate. A second, hollow, threaded portion 62 is connected at 64 to tubing 56. Portion 62 includes a spring 66 acting against a threaded extension 68 extending from portion 62. It will be seen that any fluid disposed within pump casing 12 above standing valve 24 will be able to flow upwardly through the center of travel valve 46, past ball 50, and into the upper portion of pump casing 12 near first end portion 14. In a manner similar to standing valve 24, oil cannot flow backwardly through travel valve 46 once the oil has passed ball 50.

Concentrically disposed about pump casing 12 is an outer casing 70. Outer casing 70 is adapted to fit over a portion of fittings 22 and 42 so as to be retained therebetween. Fitting 22 is provided with an O-ring 72, and fitting 42 is provided with an O-ring 74, in order to provide a fluid-tight seal between the fittings and outer casing 70. Pump casing 12 and outer casing 70 are sized appropriately to form an annular space or reservoir 76 therebetween.

Figure 3:
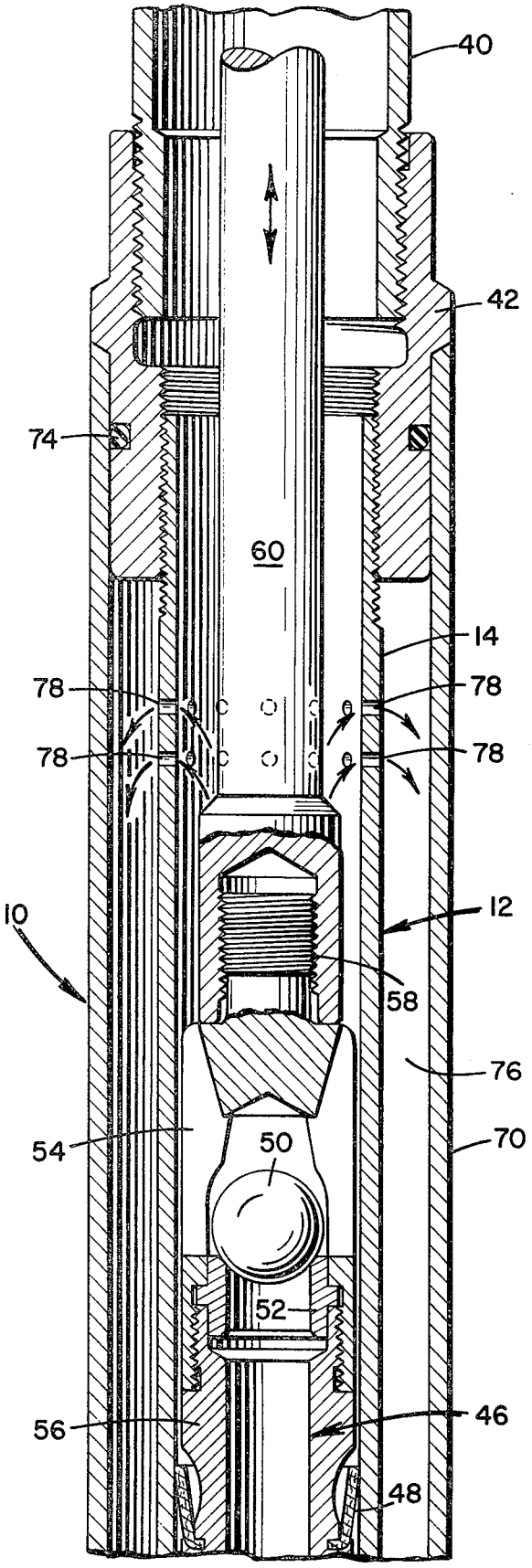
FIG. 3 is a view similar to FIG. 1 depicting the upper portion of the pump of FIG. 1.
Figure 4:
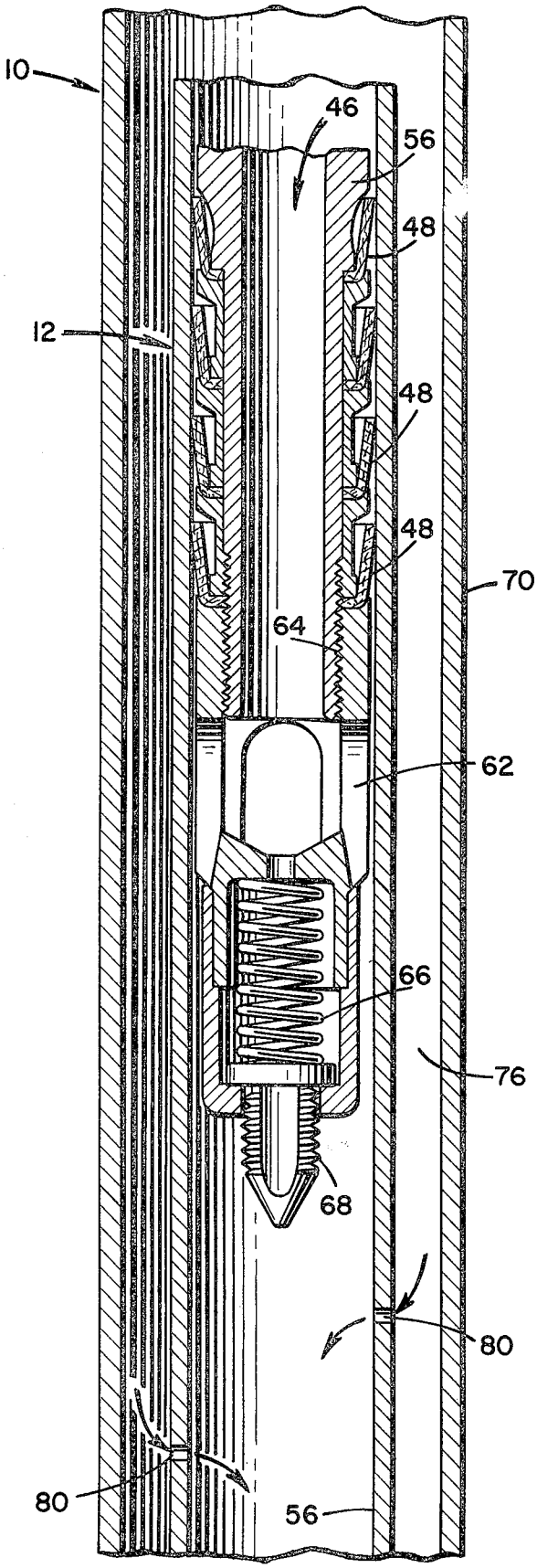
FIG. 4 is a view similar to FIG. 1 depicting the central portion of the pump of FIG. 1.

As shown best by FIG. 3, pump casing 12 is provided with a plurality of circumferentially disposed openings 78. Openings 78 are disposed proximate first end portion 14. Pump casing 12 also includes a second set of openings 80, which openings are disposed adjacent travel valve 46. Pump casing 12 also includes an opening 82 disposed proximate second end portion 16 and immediately above portion 32 of standing valve 24.

Figure 5:
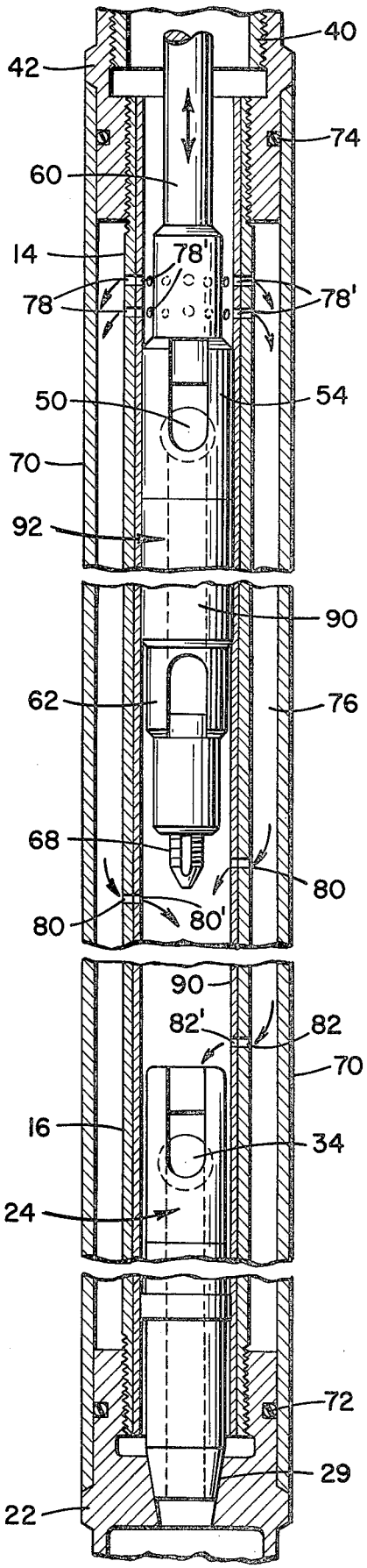
FIG. 5 is a side elevational view, partly in section, of another pump according to the invention.

FIG. 5 illustrates an alternative embodiment of the invention. The embodiment shown by FIG. 5 is known as an insert pump, because an insert, or liner 90 is tightly fitted therein. A pumping member or plunger 92 replaces travel valve 46 of the first embodiment. Plunger 92 and liner 90 are sized carefully so as to form a substantially fluid-tight seal therebetween without the use of sealing cups. In order to maintain a fluid-tight seal between plunger 92 and liner 90, plunger 92 is longer than travel valve 46 of the first embodiment, although the relative length of plunger 92 is not shown by FIG. 5. In all other respects, the embodiment shown by FIG. 5 is identical to that of FIG. 1 and, for convenience, the numerals employed with FIG. 1 have been carried over to FIG. 5. It is noted specifically that liner 90 includes openings 78', 80' and 82'. These openings are the same size as openings 78, 80 and 82 and are coincident therewith.

OPERATION

Upon start-up of the power source, sucker rod 60 is caused to reciprocate. In turn, travel valve 46 likewise reciprocates. On an upward stroke, travel valve 46 causes oil to be pulled through mud anchor 20 and standing valve 24 into the interior of pump casing 12. On the following downward stroke, the oil contained within the interior of pump casing 12 is trapped by ball 34 of standing valve 24. Thus, the oil is forced through the interior of travel valve 46, past ball 50, and into the upper portion of pump casing 12. On a subsequent upward stroke, the oil is forced upwardly into well tubing 40 by the combined action of sealing cups 48 and ball 50.

Additionally, a portion of the oil forced upwardly into well tubing 40 is forced into reservoir 76 through openings 78. As travel valve 46 continues to reciprocate, more and more oil is forced into reservoir 76 until reservoir 76 is filled. At the same time, a portion of the oil in reservoir 76 is recirculated back into the interior of pump casing 12 through openings 80 and 82.

If the supply of oil available to be pumped should decrease, it is apparent that no more oil would enter the interior of pump casing 12 through mud anchor 20 and standing valve 24. However, burnout of sealing cups 48 is prevented by the recirculating flow of pumped fluid flowing between reservoir 76 and the interior of pump casing 12. As travel valve 46 continues to reciprocate, oil from reservoir 76 will reenter pump casing 12 through openings 80 and 82. Oil flowing through openings 80 will directly lubricate sealing cups 48. Additionally, oil flowing through opening 82 will collect over standing valve 24. This oil, in turn, will be forced through the interior of travel valve 46 and past ball 50. Thereafter, the oil will again be forced through openings 78 and back into reservoir 76, where the cycle will continue. In the embodiment shown in FIG. 5, the same result will be obtain.

The combined cross-sectional area of openings 78 is greater than the combined cross-sectional area of openings 80 and 82. This permits oil to enter reservoir 76 at a greater rate than oil can be withdrawn from reservoir 76. In the event an adequate supply of oil is available to be pumped, such a condition is desired in order to maintain a high pump efficiency. That is, under normal operating conditions, only a small amount of oil will be recirculated, the rest being pumped to the surface. However, if the supply of oil available to be pumped should decrease, openings 80 and 82 will nevertheless permit enough oil to recirculate to adequately lubricate the pumping member and prevent scoring of the pump casing or liner. It is to be understood that openings 78, 80 and 82 can be sized and arranged in any manner as long as the above-mentioned conditions are met.

When it is desired to remove the pumping member and standing valve from the well, sucker rod 60 may be disengaged from the power source and travel valve 46 or plunger 90 lowered further into the well. Threaded extension 68 will engage threaded portion 38 upon rotation of sucker rod 60, thus connecting standing valve 24 to travel valve 46 or plunger 90, as the case may be. Thereafter, the pumping member and standing valve may be removed from the well as a unit. During this operation, spring 66 serves to properly align threaded extension 68 and threaded portion 38 to prevent the stripping of threads.

It will be apparent that the present invention overcomes the difficulties associated with prior art pumps. Since a continuous, recirculating flow of pumped fluid is available to lubricate the pumping member, burnout of the sealing cups or plunger is prevented. Therefore, the need for a timer to interrupt operation of the pumping member is eliminated. Additionally, scoring of the pump casing or liner is prevented because any entrained abrasive material will not tend to settle toward the bottom of the well because the pumping member continually is in motion. This, in turn, obviates the need for sand traps to collect abrasive material or lubricants other than pumped fluid to exclude abrasive material from the space between the pumping member and the pump casing or liner.

An unexpected benefit of the present invention has been an increased production of oil from stripper wells. This is thought to be because the continual reciprocation of the pumping member tends to erode the oil bearing strata, or pay surrounding the mud anchor. Unlike previous stripper wells having timed intervals of operation, the present invention permits a continual suction to be applied to the pay, with the result that more and more production of oil is stimulated. Experiments have shown that the increased production in stripper wells has been as much as five times that previously known with prior art down-hole pumps. This result has been achieved without the previously mentioned prior art problems of scoring of the pump casing or liner or burnout of pumping members when initially determining the proper period of operation with timing devices.

With a specific embodiment of the invention has been described, it will be obvious to those skilled in the art that changes and modifications may be made without departing from the invention. It is therefore intended in the appended claims to cover all such changes and modifications that fall within the true spirit and scope of the invention.

I claim:

1. A fluid pump for subsurface operation, comprising:

a. a pump casing having first and second end portions;

b. a pumping member disposed for movement in said pump casing for pumping fluid into said pump casing through said second end portion and out of said pump casing through said first end portion;

c. an outer casing disposed about said pump casing so as to form a reservoir between said pump casing and said outer casing;

d. at least one valveless opening in said pump casing disposed proximate said first end portion of said pump casing for permitting fluid to flow from said pump casing into said reservoir;

e. at least one valveless opening in said pump casing disposed proximate said second end portion of said pump casing for permitting fluid to flow from said reservoir into said pump casing, the total cross-sectional area of the valveless opening or openings in said pump casing disposed proximate said second end portion of said pump casing being less than the total cross-sectional area of the valveless opening or openings in said pump casing disposed proximate said first end portion of said pump casing, whereby a portion of the pumped fluid may be recirculated between the interior of said pump casing and said reservoir to lubricate continuously said pumping member upon movement thereof and whereby the pumped fluid is permitted to enter said pump casing from said reservoir at a lesser rate than the pumped fluid is permitted to enter said reservoir from said pump casing.

2. The apparatus of claim 1 wherein said pump casing additionally includes at least one valveless opening disposed adjacent said pumping member.

3. The apparatus of claim 1 wherein said fluid pump additionally comprises:

a. a liner disposed within said pump casing, said pumping member being disposed for movement in said liner and forming a substantially fluid-tight seal between said pumping member and said liner; and b. valveless openings in said liner in fluidic communication with said valveless openings in said pump casing, whereby a portion of the pumped fluid may be recirculated between the interior of said liner and said reservoir to lubricate continuously said pumping member upon movement thereof and whereby the pumped fluid is permitted to enter said liner from said reservoir at a lesser rate than the pumped fluid is permitted to enter said reservoir from said liner.

4. The apparatus of claim 3 wherein:

a. said pump casing additionally includes at least one valveless opening disposed adjacent said pumping member; and b. said liner additionally includes at least one valveless opening disposed adjacent said pumping member and in fluidic communication with said valveless opening or openings in said pump casing disposed adjacent said pumping member.

5. In a fluid pump for subsurface operation having a pump casing with first and second end portions and having a reservoir disposed thereabout, a method for preventing burnout of a pumping member disposed for movement within the pump casing, comprising:

a. recirculating a portion of the fluid pumped by said pumping member between said pump casing and said reservoir through valveless openings in said pump casing, said openings disposed proximate said first end portion of said pump casing for permitting pumped fluid to flow into said reservoir from said pump casing and proximate said second end portion of said pump casing for permitting pumped fluid to flow into said pump casing from said reservoir; and b. constructing said valveless openings so that the total cross-sectional area of the valveless opening or openings in said pump casing disposed proximate said second end portion of said pump casing is less than the total cross-sectional area of the valveless opening or openings in said pump casing disposed proximate said first end portion of said pump casing, whereby said pumping member is lubricated continuously upon movement thereof and wherein said pumped fluid is permitted to enter said pump casing from said reservoir at a lesser rate than said pumped fluid is permitted to enter said reservoir from said pump casing.

6. The method of claim 5 wherein said pumped fluid is recirculated through at least one valveless opening in said pump casing disposed adjacent said pumping member.

* * * * *